United States Patent [19]

Proud et al.

[11] Patent Number: 4,495,435

[45] Date of Patent: Jan. 22, 1985

[54] PLASMA SWITCH

[75] Inventors: Joseph M. Proud, Wellesley Hills; Walter P. Lapatovich, Watertown, both of Mass.

[73] Assignee: GTE Laboratories Incorporated, Waltham, Mass.

[21] Appl. No.: 402,174

[22] Filed: Jul. 26, 1982

[51] Int. Cl.[3] ..... H01J 17/26

[52] U.S. Cl. ..... 313/231.31; 313/12; 200/148 G

[58] Field of Search ..... 313/231.31, 231.41, 313/231.51, 12; 315/111.01; 200/148 G, 148 E

[56] References Cited

U.S. PATENT DOCUMENTS

| | | | |
|---|---|---|---|
| 3,586,898 | 6/1971 | Speros et al. | 313/635 |
| 3,637,966 | 1/1972 | Moller | 200/148 G |
| 4,019,079 | 4/1977 | Hardin | 313/231.41 |
| 4,020,306 | 4/1977 | Zahner et al. | 200/148 G |
| 4,322,661 | 3/1982 | Harvey | 313/161 X |

*Primary Examiner*—David K. Moore
*Assistant Examiner*—K. Wieder
*Attorney, Agent, or Firm*—J. Stephen Yeo

[57] ABSTRACT

A plasma switch includes means to introduce a cloud of particulate $AlI_3$ or $AlCl_3$ and $SiO_2$ is to a conductive gas discharge. The chemicals undergo a plasma reaction and generate $SiI_4$ or $SiCl_4$ both of which are efficient electron absorbers which rapidly extinguish the gas discharge.

6 Claims, 1 Drawing Figure

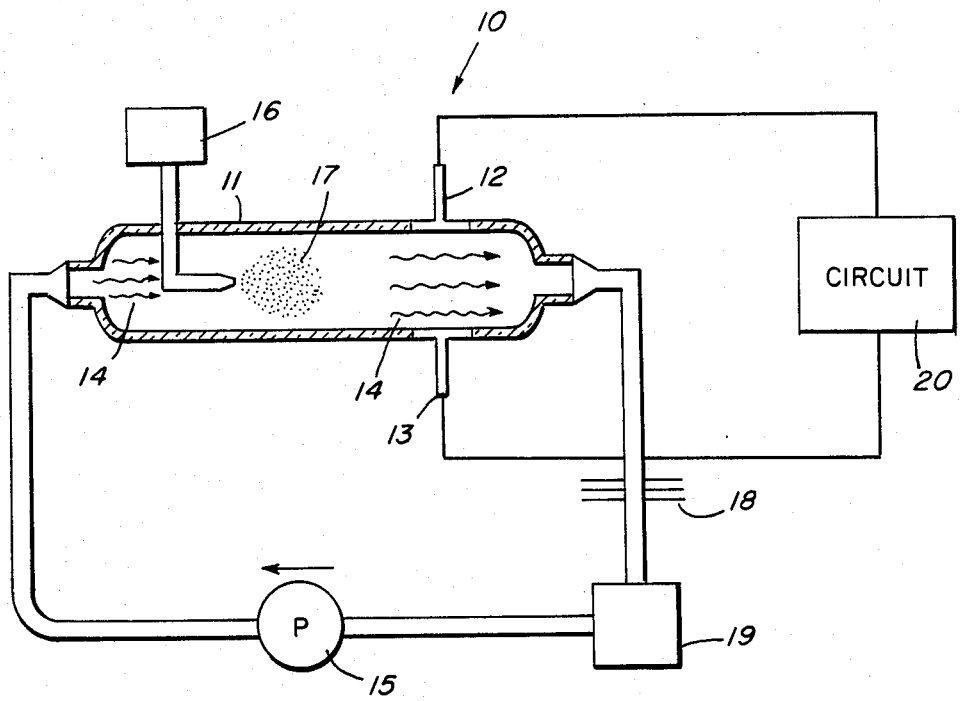
10
16
11
17
12
CIRCUIT
14
14
13
20
18
P
19
15

PLASMA SWITCH

BACKGROUND OF THE INVENTION

This invention is concerned with plasma discharge devices, and, more particularly, is concerned with electric switches utilizing plasma discharges.

Some electrical designs require means for interrupting a high current flow with a nearly instantaneous switching action. Consider, for example, a power source supplying current to an inductor through a closed switch. Energy is stored in the inductor until the switch is opened. Opening the switch allows the inductor to discharge its energy through any impedance which may be in shunt with the switch.

It is known for switches to utilize the conduction characteristics of plasma. Well-known plasma switching devices include spark gaps and neon lamp relaxation oscillators. A more recent device is a "Cross-field Plasma Mode Electric Conduction Control" device divulged in U.S. Pat. No. 4,322,661, issued to Harvey on Mar. 30, 1982. Apparently the Harvey device applies a magnetic field to control electron flow in a plasma discharge. The switching speed in such a device is probably limited by the inductance of the magnetic circuit. Another such plasma device is the e-beam controlled switch in which electrons are ejected into a gas to support a discharge.

According to the present invention there is provided an electric switch which is "on" during a plasma discharge through an inert gas. The discharge is extinguished by the reaction products of aluminum trichloride or aluminum tri-iodide and silicon dioxide. The specific reaction product responsible for the plasma extinction in $SiCl_4$ or $SiI_4$. This chemical reaction is known to those skilled in the art of discharge lamps. U.S. Pat. No. 3,586,898 issued June 22, 1971 to Speros and Smyer discussed the use of aluminum trichloride and aluminum tri-iodide in a mercury vapor lamp. It was realized that $AlCl_3$ would gradually react with silicon on the surface of a silica envelope and release sufficient $SiCl_4$ over a period of time to change light transmission and vapor pressure. The Speros and Smyer patent is directed towards suppressing $SiCl_4$ generation by using non-reactive envelopes.

U.S. patent application Ser. No. 402,175, filed 7/26/82 concurrently with this, divulges a mercury-free aluminum trichloride lamp. $SiCl_4$ is regarded as a contaminant and an aluminum silicate coated envelope is disclosed.

It is an object of this invention to provide an electric switch utilizing a plasma discharge during its "on-state" and having a nearly instantaneous transition from conducting to non-conducting conditions;

another object is to provide an electric switch utilizing a plasma chemical reaction to extinguish current flow; and an additional object is to provide a high current switch capable of a switching rate of approximately 1 KHz.

SUMMARY OF THE INVENTION

Briefly, there is provided a plasma switch for rapidly changing from an on-state to an off state. The switch includes a discharge tube which carries two electrodes. A stream of noble gas is caused to passed by the electrodes where it supports a plasma discharge allowing current to flow. To turn off the switch, a mixture of $MX_3$ and $SiO_2$ particles are ejected into the gas stream. M is a Group III metal such as aluminum. X is a halogen such as iodine or chlorine. As the $MX_3$ approaches the discharge region, the temperature and corresponding vapor pressure increases. The increase in vapor pressure increases the breakdown voltage of the plasma. The chemicals react in the plasma discharge to form $SiX_4$ which quenches electrons and extinguishes the plasma discharge. Quenching also aided by rapidly increasing press of $AlCl_3$ as plasma heats the volatiles.

The noble gas may have a vapor pressure of about 10 torr. The particle size of the $MX_3$ and $SiO_2$ is preferably about 100 Å. The mixture has a preferred density of about 1 mg/cm$^3$ upon ejection.

In one embodiment of the invention means are provided to remove the spent chemicals from the noble gas and recycle the gas.

DESCRIPTION OF THE DRAWING

The single drawing illustrates an electric switch which embodies the invention.

DESCRIPTION OF THE INVENTION

The drawing is a schematic representation of a chemically reactive plasma switch 10 embodying the invention. The exemplary embodiment is a single pole, single throw switch having an "on-state" and an "off-state". The body of the switch is a discharge tube 11 which may be made of a high temperature glass such as silica ($SiO_2$), or a ceramic such as alumina ($Al_2O_3$). Electrodes 12, 13 are diametrically opposed on the walls of the tube 11 and are connected to the circuit 20 to be switched.

A stream of noble gas 14, such as neon, flows through the discharge tube 11 at a pressure of about 10 torr. Preferably the noble gas is recycled by means of pump 15.

The noble gas supports a discharge in the region between the electrodes 12 and 13. Neon, for example, breaks down and supports a discharge at a potential less than 10 V/cm-torr. The voltage between electrodes 12 and 13 may be high enough to initiate the discharge or an axillary starting means (not shown) known in the discharge device art may be employed. In either case it is assumed that once the discharge is started it is self-sustaining.

This discharge condition is the "on-state" of the switch when high current can flow in the conductive plasma with relatively little voltage drop. For neon, the effective plasma resistance is about 0.1 ohm. The product of voltage drop and current flow corresponds to the energy dissipated in the plasma mainly as heat.

An ejector 16 is arranged to release a predetermined amount of fully mixed particulate $AlCl_3$ and $SiO_2$ upstream from the discharge region. The preferred particle size is about 100 Å. The released particulate forms a particulate cloud 17 having a density of about 1 mg/cm$^3$.

The particulate cloud is carried by the noble gas stream to the discharge region between electrodes 12 and 13 where heat and electron bombardment vaporizes the $AlCl_3$ in about 75 $\mu$s. At 160° C. the $AlCl_3$ vapor pressure is about 250 torr. Successive electron collisions dissociate the $AlCl_3$ molecules into molecular and atomic fragments, particularly $AlCl_2$, AlCl, Al, Cl, and excited species thereof. The total energy to disassociate a single $AlCl_3$ molecule is estimated to be about 13 eV.

The fragments undergo exothermic reactions with the particulate $SiO_2$. The most favorable reaction pathways include:

$$4Al+3SiO_2 3Al_2O_3+3Si$$

$$Si+4ClSiCl_4$$

$$3Al_2O_3+2SiO_2 3Al_2O_3.2SiO_2$$

The heat generated by the reactions helps vaporize more $AlCl_3$, increasing its vapor pressure. The increase in vapor pressure in the discharge region increases the breakdown voltage in the region, forcing the switch towards a non-conducting state. About 10% of the available $AlCl_3$ vapor reacts with $SiO_2$ in a few microseconds.

The reaction product $SiCl_4$ is a highly volatile and effective electron scavenger which quickly quenches the plasma discharge.

Ion spectroscopic studies which have been conducted on $SiCl_4$ provide some insight into the mechanisms whereby energetic electrons are removed from the plasma. Electron collisions with $SiCl_4$ produce many different ions: $SiCl_3$, $SiCl_2$, and $Cl_2$, and $Cl^-$. In producing $Cl^-$, for example, two thresholds are observed at electron energies of 0.5 and 5.7 eV, with peaks in the ions production curves at 1.8 and 7.5 eV, respectively. Peak efficiencies for production of the other ions mentioned occur at electron energies between 7 and 9 eV. Thus $SiCl_4$ and its dissociated products act as a sponge, soaking up both high- and low-energy electrons and producing ions, some calculated to be in excited electronic states. The energy absorbed in such processes is sufficient to quench the discharge. The dominant quenching channel is uncertain although bombardment by well-defined electron beams seems to favor production of $Cl^-$ and $SiCl_2$ ions.

The presence of $SiCl_4$ and increased pressure of vaporized $AlCl_3$ in the discharge region prevents current flow between the electrodes. The switch is now in its "off-state" and remains so until the $SiCl_4$ is flushed from the discharge region by the gas stream and another discharge initiated. The residual $AlCl_3$ and reaction products $SiCl_4$ and $3Al_2O_3.2SiO_2$ are subsequently cooled by radiators 18 and removed from the noble gas stream by filter 19. The noble gas may then be recycled by pump 15.

The switching cycle may be repeated at a 1000 cps rate, depending upon the flow rate of the gas stream.

As a feature of the invention the $SiCl_4$ is generated in situ with the discharge region. This makes for a more instantaneous transition between "on" and "off" states than would be possible if $SiCl_4$ was released upstream and introduced gradually into the discharge region. $AlI_3$ or another metal halide may be substituted for $AlCl_3$. If M represents a group IIIA metal from the period table and X represents a halogen, the general reaction: $12MX_3+13SiO_2\ 2(3M_2O_3.2SiO_2)+9SiX_4$ can be expected. $SiI_4$ has been found to be a very effective electron quenching agent.

The preferred embodiment has been described. Other embodiments and modifications thereof will be apparent to those skilled in the art so that the scope of the invention is defined by the claims.

We claim:

1. A plasma switch for switching an electrical circuit having a voltage potential, comprised of:

a discharge tube;

at least two electrodes arranged in said tube and adapted to be coupled to said voltage potential;

means for moving a gas stream of noble gas through said tube, said noble gas supporting a plasma discharge between said electrodes, whereupon said switch is in an on-state; and means for ejecting a mixture of $MX_3$ and $SiO_2$ particles into said gas stream upstream from said electrodes, wherein M is a metal selected from Group IIIA of the periodic table and X is a halogen, said mixture reacting in said plasma discharge increasing the vapor pressure of the $MX_3$ and generating $SiX_4$ thereby quenching electrons and extinguishing said plasma discharge whereupon said switch is in an off-state.

2. The plasma switch of claim 1 wherein M is aluminum and X is iodine.

3. The plasma switch of claim 1 wherein M is aluminum and X is chlorine.

4. The plasma switch of claims 1, 2 or 3 wherein said noble gas has a vapor pressure of about 10 torr.

5. The plasma switch of claims 1, 2 or 3 wherein the particle size is about 100 A and the ejected mixture has a density of about 1 $mg/cm^3$.

6. The switch of claim 1 which includes means to remove residual of the mixture and products of reaction from said gas stream and means to recycle said noble gas.

* * * * *